US009555909B2

(12) United States Patent
Chu et al.

(10) Patent No.: US 9,555,909 B2
(45) Date of Patent: Jan. 31, 2017

(54) METHOD FOR MANUFACTURING STICK-TYPE TEA BAG

(71) Applicant: TIREMO INC., Incheon (KR)

(72) Inventors: KwangNo Chu, Incheon (KR); Wooseung Seo, Seongnam-si (KR)

(73) Assignee: TIREMO INC., Incheon (KR)

( * ) Notice: Subject to any disclaimer, the term of this patent is extended or adjusted under 35 U.S.C. 154(b) by 498 days.

(21) Appl. No.: 14/355,497

(22) PCT Filed: Nov. 22, 2012

(86) PCT No.: PCT/KR2012/009902
§ 371 (c)(1),
(2) Date: Apr. 30, 2014

(87) PCT Pub. No.: WO2013/085178
PCT Pub. Date: Jun. 13, 2013

(65) Prior Publication Data

US 2014/0290184 A1 Oct. 2, 2014

(30) Foreign Application Priority Data

Dec. 5, 2011 (KR) ..... 10-2011-0128858

(51) Int. Cl.
*B65B 3/02* (2006.01)
*B65B 5/06* (2006.01)
(Continued)

(52) U.S. Cl.
CPC ..... *B65B 29/02* (2013.01); *B65B 1/00* (2013.01); *B65B 39/12* (2013.01); *B65D 85/812* (2013.01)

(58) Field of Classification Search
CPC ..... B65B 29/02; B65B 9/023; B65B 1/00; B65B 9/02; B65B 3/02; B65B 3/027; B65B 5/06; B65B 5/062; B65B 5/10; B65B 5/101; B65D 85/8043; B65D 85/8046; B65D 85/808
(Continued)

(56) References Cited

U.S. PATENT DOCUMENTS 3,782,066 A * 1/1974 Schmitt ..... A61J 1/067 53/412
3,789,710 A * 2/1974 Silverstein ..... B26F 1/24 83/16
(Continued)

FOREIGN PATENT DOCUMENTS

JP 0516967 A 1/1993
JP 2001112630 A 4/2001
(Continued)

*Primary Examiner* — Andrew M Tecco
*Assistant Examiner* — Praachi M Pathak
(74) *Attorney, Agent, or Firm* — Novick, Kim & Lee, PLLC; Sang Ho Lee

(57) ABSTRACT

Disclosed is a method for manufacturing a stick-type tea bag, which includes (a) forming a part of a board to form a pair of holes symmetrically based on a virtual center line formed at the board, (b) disposing a jig, which has grooves at locations respectively corresponding to the pair of holes, below the board, (c) disposing a mesh member on the pair of holes to respectively cover the pair of holes, (d) attaching an edge of the mesh member to a part of the board adjacent to the holes by pushing an upper portion of the mesh member with a push rod, in a state in which the push rod is inserted into the groove, and (e) adhering inner sides of the board in a state in which the board is folded based on the center line with tea being interposed therein so that the tea is confined in a storage bag.

7 Claims, 12 Drawing Sheets

(51) Int. Cl.

| | |
|---|---|
| ***B65B 5/10*** | (2006.01) |
| ***B65B 29/02*** | (2006.01) |
| ***B65B 9/02*** | (2006.01) |
| ***B65B 1/00*** | (2006.01) |
| ***B65B 39/12*** | (2006.01) |
| ***B65D 85/812*** | (2006.01) |

(58) Field of Classification Search
USPC ..... 53/452, 454, 456
See application file for complete search history.

(56) References Cited

U.S. PATENT DOCUMENTS 4,262,473 A * 4/1981 Brooke ..... B65B 9/20 53/450
4,437,293 A * 3/1984 Sanborn, Jr. ..... B29C 66/346 53/133.4
4,571,924 A * 2/1986 Bahrani ..... B65B 29/02 141/67
4,790,803 A * 12/1988 Roen ..... B31B 19/98 493/195
4,998,621 A * 3/1991 Meehan ..... A45D 40/0087 206/466
5,012,629 A * 5/1991 Rehman ..... B65B 29/02 206/0.5
5,233,813 A * 8/1993 Kenney ..... B65B 29/02 53/373.4
5,440,976 A * 8/1995 Giuliano ..... A47G 21/004 206/220
5,459,980 A * 10/1995 Kenney ..... B65B 29/02 53/373.4
5,511,359 A * 4/1996 Kenney ..... B29C 65/02 53/134.2
5,637,335 A * 6/1997 Fond ..... B65B 29/02 426/111
5,806,409 A * 9/1998 Johnson ..... A47J 31/20 99/279
5,951,452 A * 9/1999 Stevenson ..... B65B 9/02 493/193
5,967,019 A * 10/1999 Johnson ..... A47J 31/20 99/279
9,173,728 B2 * 11/2015 Wurtz ..... A61D 7/00
9,469,435 B2 * 10/2016 Greenland ..... B65B 3/02
2003/0234203 A1 * 12/2003 Urban ..... B65D 75/327 206/530
2004/0005384 A1 * 1/2004 Cai ..... A47J 31/0647 426/77
2007/0011993 A1 * 1/2007 Mannoia ..... B65B 61/20 53/452
2011/0200713 A1 * 8/2011 Simone ..... B65D 85/808 426/78
2012/0085672 A1 * 4/2012 Gelardi ..... B65D 75/30 206/484
2013/0277887 A1 * 10/2013 Howarth ..... B29C 51/28 264/321
2013/0277888 A1 * 10/2013 Woodward ..... B29C 51/004 264/321
2014/0290184 A1 * 10/2014 Chu ..... B65B 39/12 53/453
2015/0151902 A1 * 6/2015 Woodward ..... B65D 85/808 426/84

FOREIGN PATENT DOCUMENTS

KR 200282242 Y1 7/2002
KR 200423252 Y1 8/2006

* cited by examiner

METHOD FOR MANUFACTURING STICK-TYPE TEA BAG

TECHNICAL FIELD

The present disclosure relates to a method for manufacturing a stick-type tea bag, and more particularly, to a method for manufacturing a stick-type tea bag, which may effectively ensure a space of a storage bag to contain tea.

BACKGROUND ART

A general tea bag includes a filter paper in which tea is packed, a thread connected to one side of the filter paper, and a handle attached to an end of the thread. In this case, the filter paper is put into a cup containing hot water, and then, if the tea is brewed, a user takes the filter paper out of the cup by using the thread and drinks the tea. In other case, a handle unit made of paper or plastic is connected to a part of the top of the filter paper.

In case of the general tea bag, it is impossible to stir tea to brew the tea. For this reason, a user should place the filter paper in a cup and wait until tea is brewed in hot water.

In addition, in case of the general tea bag, if the filter paper is dipped in water, since the filter paper is heavy in comparison to the handle unit, the thread of the handle unit may be separated from the filter paper when the user shakes the filter paper or takes the filter paper out of water by using the handle unit.

DISCLOSURE

Technical Problem

The present disclosure is directed to providing a method for manufacturing a stick-type tea bag composed of a storage bag for storing tea and a hard handle for supporting the storage bag.

In addition, the present disclosure is directed to providing a method for manufacturing a stick-type tea bag, which may sufficiently ensure a space of the storage bag.

Moreover, the present disclosure is directed to providing a method for manufacturing a stick-type tea bag by means of thermal fusing.

Technical Solution

In one aspect of the present disclosure, there is provided a method for manufacturing a stick-type tea bag, which includes:

(a) forming a part of a board to form a pair of holes symmetrically based on a virtual center line formed at the board;

(b) disposing a jig, which has grooves at locations respectively corresponding to the pair of holes, below the board;

(c) disposing a mesh member on the pair of holes to respectively cover the pair of holes;

(d) attaching an edge of the mesh member to a part of the board adjacent to the holes by pushing an upper portion of the mesh member with a push rod, in a state in which the push rod is inserted into the groove; and (e) adhering inner sides of the board in a state in which the board is folded based on the center line with tea being interposed therein so that the tea is confined in a storage bag.

In addition, a plurality of hole pairs may be formed in a row along the center line, and the step (e) may include:

(e1) folding the board and adhering inner sides of the board so that three sides of the board are closed; and (e2) injecting the tea through an open side of the board, and then adhering the open side to close the board.

In addition, a synthetic resin film may be coupled to the board, in the step (d), the edge of the mesh member may be thermally fused to the synthetic resin film attached to the board so that the edge of the mesh member is coupled to a part of the board, and in the step (e), the synthetic resin films at inner sides of the board may be thermally fused to each other so that the inner sides of the board are adhered.

In addition, a fold line may be formed at the center line to help folding of the board.

In another aspect of the present disclosure, there is also provided a method for manufacturing a stick-type tea bag, which includes:

(f) removing a part of a board to form a hole;

(g) disposing a jig, which has a groove at a location corresponding to the hole, below the board;

(h) disposing a mesh member above the hole to cover the hole;

(i) attaching an edge of the mesh member to a part of the board adjacent to the hole by pushing an upper portion of the mesh member with a push rod, in a state in which the push rod is inserted into the groove; and (j) adhering inner sides of the board in a state in which the board is folded based on a center line of the hole with tea being interposed therein so that the tea is confined in a storage bag.

In addition, a synthetic resin film may be coupled to the board, in the step (i), the edge of the mesh member may be thermally fused to the synthetic resin film attached to the board so that the edge of the mesh member is coupled to a part of the board, and in the step (j), the synthetic resin films at inner sides of the board may be thermally fused to each other so that the inner sides of the board are adhered.

In another aspect of the present disclosure, there is also provided a method for manufacturing a stick-type tea bag, which includes:

(k) forming a first hole in a first board and forming a second hole in a second board;

(l) disposing a first jig, which has a first groove at a location corresponding to the first hole, below the first board and disposing a second jig, which has a second groove at a location corresponding to the second hole, below the second board;

(m) disposing a first mesh member on the first hole to cover the first hole and disposing a second mesh member on the second hole to cover the second hole;

(n) attaching an edge of the first mesh member to a part of the first board adjacent to the first hole by pushing an upper portion of the first mesh member with a first push rod, in a state in which the first push rod is inserted into the first groove, and attaching an edge of the second mesh member to a part of the second board adjacent to the second hole by pushing an upper portion of the second mesh member with a second push rod, in a state in which the second push rod is inserted into the second groove; and (o) adhering the first board and the second board in a state in tea is interposed between the first mesh member and the second mesh member.

Advantageous Effects

The present disclosure provides a method for manufacturing a stick-type tea bag composed of a storage bag for storing tea and a hard handle for supporting the storage bag.

In addition, the present disclosure provides a method for manufacturing a stick-type tea bag, which may sufficiently ensure a space of the storage bag.

Moreover, the present disclosure provides a method for manufacturing a stick-type tea bag by means of thermal fusing.

DESCRIPTION OF DRAWINGS

FIGS. 2 to 10 are diagrams for illustrating a method for manufacturing a stick-type tea bag according to the first embodiment of the present disclosure, wherein FIG. 2 is a plane view, FIGS. 3 to 8 are cross-sectional views, and FIGS. 9 and 10 are perspective views.

FIGS. 12 to 18 are diagrams for illustrating a method for manufacturing a stick-type tea bag according to the second embodiment of the present disclosure, wherein FIGS. 12 to 17 are cross-sectional views, and FIG. 18 is a plane view.

FIGS. 20 to 26 are diagrams for illustrating a method for manufacturing a stick-type tea bag according to the third embodiment of the present disclosure, wherein FIG. 20 is a plane view. FIGS. 21 to 25 are cross-sectional views, and FIG. 26 is a perspective view.

BEST MODE

A method for manufacturing a stick-type tea bag is disclosed. The method for manufacturing a stick-type tea bag includes (a) forming a part of a board based on a virtual center line formed at the board to form a pair of holes symmetrically; (b) disposing a jig, which has grooves at locations respectively corresponding to the pair of holes, below the board; (c) disposing a mesh member on the pair of holes to respectively cover the pair of holes; (d) attaching an edge of the mesh member to a part of the board adjacent to the holes by pushing an upper portion of the mesh member with a push rod, in a state in which the push rod is inserted into the groove; and (e) adhering inner sides of the board in a state in which the board is folded based on the center line with tea being interposed therein so that the tea is confined in a storage bag.

MODE FOR DISCLOSURE

Hereinafter, preferred embodiments of the present disclosure will be described in detail with reference to the accompanying drawings. These embodiments are just for illustrations for a person having ordinary skill in the art to easily implement the present disclosure. This does not mean that the spirit and scope of the present disclosure are limited to these embodiments.

Figure 1:
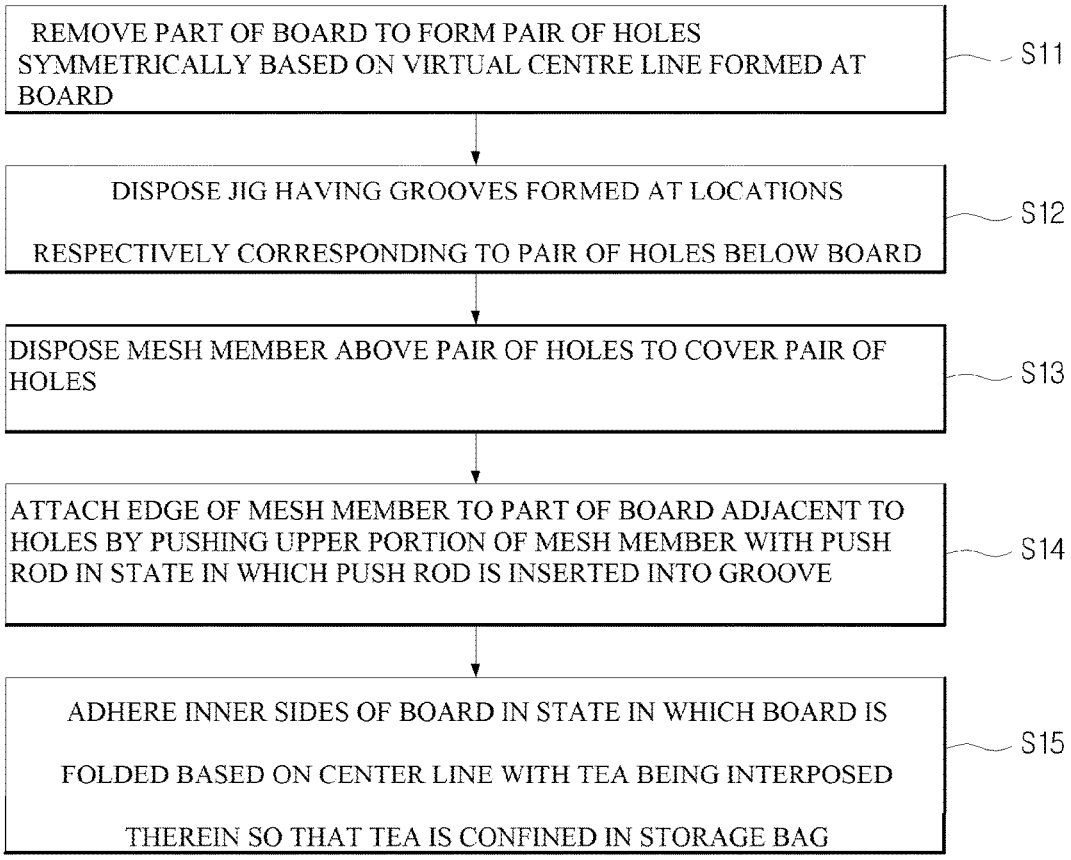
FIG. 1 is a flowchart for illustrating a method for manufacturing a stick-type tea bag according to the first embodiment of the present disclosure.

FIG. 1 is a flowchart for illustrating a method for manufacturing a stick-type tea bag according to the first embodiment of the present disclosure, and FIGS. 2 to 10 are diagrams for illustrating a method for manufacturing a stick-type tea bag according to the first embodiment of the present disclosure.

Figure 8:
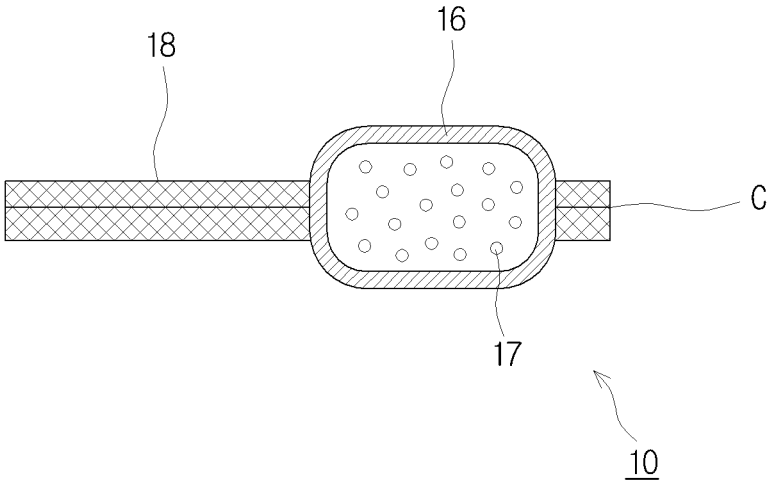

In a stick-type tea bag 10 of this embodiment, as shown in the cross-sectional view of FIG. 8, tea 17 is contained in a storage bag 16, and a handle unit 18 maintains hardness to some extent. The stick-type tea bag 10 of this embodiment is a new-type tea bag which allows stirring in a teacup containing hot water so that the tea 17 may be brewed.

A method for manufacturing the stick-type tea bag 10 of this embodiment is as follows.

S11 is a step for removing a part of a board 11 to form a pair of holes 121, 122 symmetrically based on a virtual center line C formed at the board 11. The board 11 may be made of paper, synthetic resin or wood. The board 11 may be composed of a base member 112 and a synthetic resin film 111 coupled to the upper portion of the base member 112. The synthetic resin film 111 may be a polyethylene film. The center line C may be a virtual line. In addition, the center line C may have a fold line so that the board 11 may be easily folded. As shown in the plane view of FIG. 2, the board 11 may be classified into a left region E1 and a right region E2 based on the center line C.

The pair of holes 121, 122 may be formed by punching the board 11. There may be formed a plurality of hole pairs 121, 122 along the center line C. After that, if the board 11 is cut and divided in a final process, stick-type tea bags 10 are produced one by one.

S12 is a step for disposing a jig 13, which has grooves 131, 132 formed at locations respectively corresponding to the pair of holes 121, 122, below the board 11. The jig 13 may be made of various materials such as wood, plastic or metal. The grooves 131, 132 may be formed through the jig 13 (see FIG. 4).

S13 is a step for disposing mesh members 141, 142 above the pair of holes 121, 122 to cover the pair of holes 121, 122. The mesh members 141, 142 may made of any material which allows air and water to pass and is not harmful to a human body, for example Korean paper, non-woven fabric, synthetic resin mesh or the like (see FIG. 5).

Steps S12 and S13 may be performed in order, or Step S12 may also be performed after Step S13 is performed.

S14 is a step for attaching edges of the mesh members 141, 142 to a part D1 to D4 of the board 11 adjacent to the holes 121, 122 by pushing the upper portions of the mesh members 141, 142 with push rods 151, 152 in a state in which the push rods 151, 152 are inserted into the grooves 131, 132. If the push rods 151, 152 are pressed, the mesh members 141, 142 are respectively inserted into the grooves 131, 132 in winding. In this state, the edges of the mesh members 141, 142 are attached to the part D1 to D4 of the board 11 adjacent to the holes 121, 122. The attaching method may be thermal fusing. The synthetic resin film 111 of the board 11 may be thermally melted and attached to the mesh members 141, 142. As a result, as shown in the cross-sectional view of FIG. 7, the mesh members 141, 142 maintain a downwardly convex shape.

S15 is a step for adhering inner sides of the board 11 in a state in which the board 11 is folded based on the center line C with the tea 17 being interposed therein so that the tea 17 is confined in the storage bag 16. In the cross-sectional view of FIG. 7, if the board 11 is folded based on the center line C and thermally fused, the board 11 comes into a state shown in the cross-sectional view of FIG. 8. The jig 13 may be separated after Step S15. In other case, the jig 13 may also be separated before Step S15.

Figure 2:
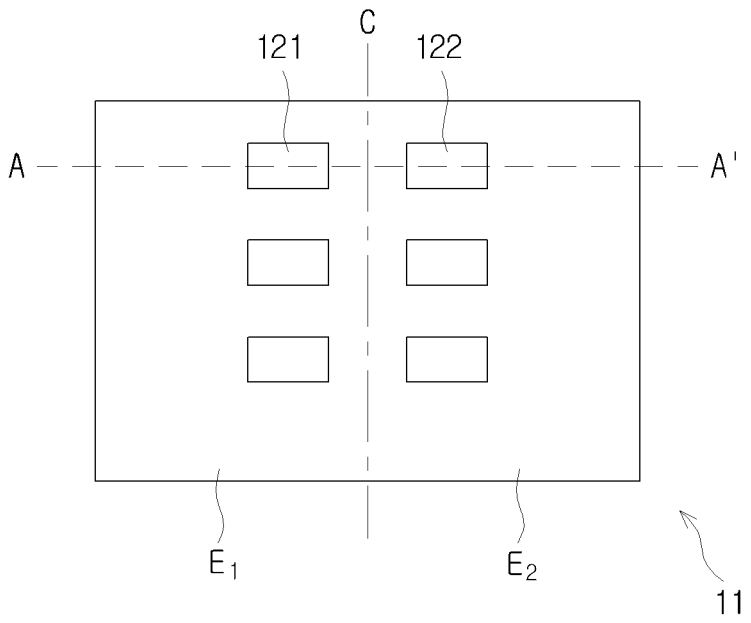
Figure 3:
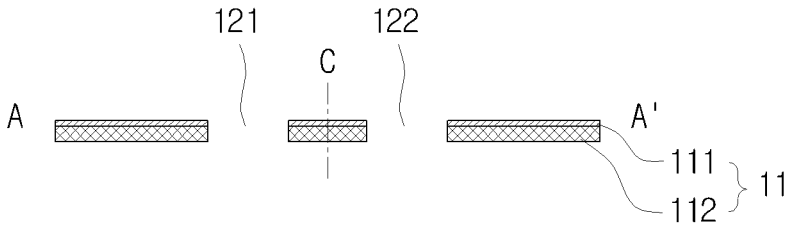
Figure 4:
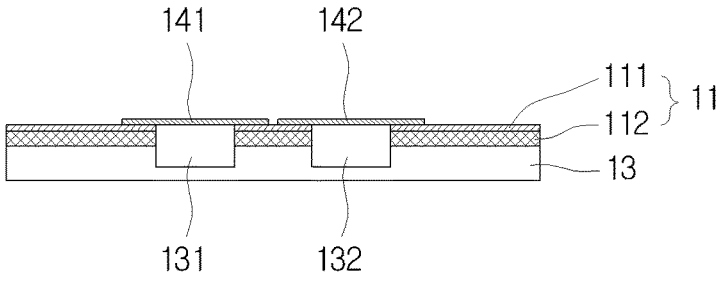
Figure 5:
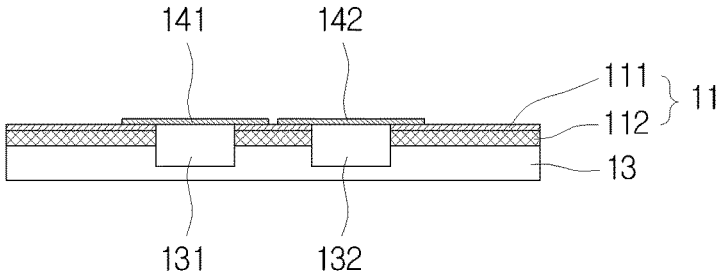
Figure 6:
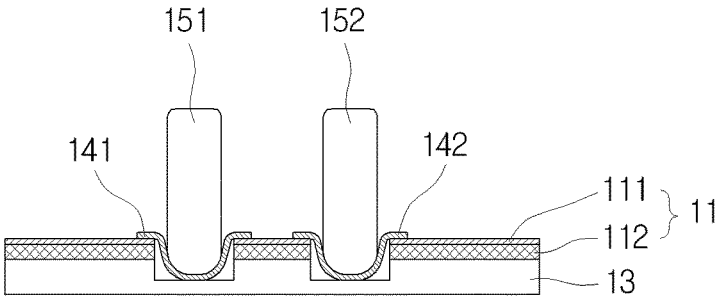

If the plurality of hole pairs 121, 122 is formed in the board 11 along the center line as shown in FIG. 2, one stick-type tea bag 10 is obtained as shown in FIG. 8 by cutting its border lines.

Figure 7:
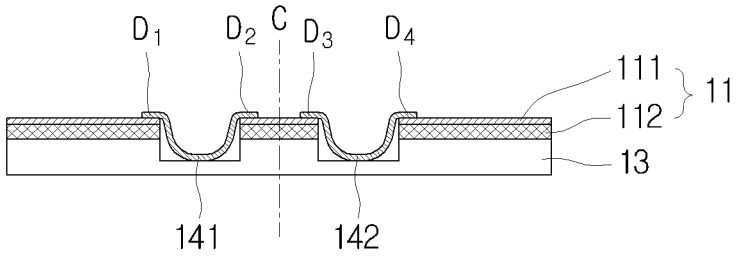

The storage bag 16 has a single confinement structure by combining a mesh member 141 and a mesh member 142 of FIG. 7. At this time, the tea 17 is interposed therein before the storage bag 16 is formed.

Figure 9:
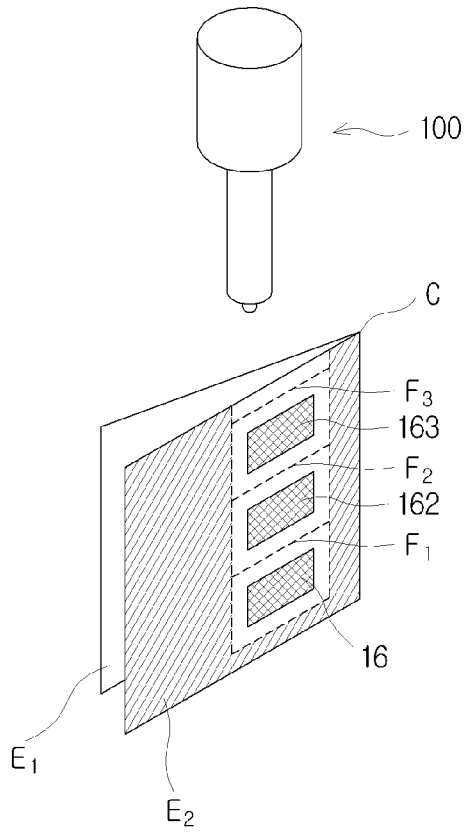
Figure 10:
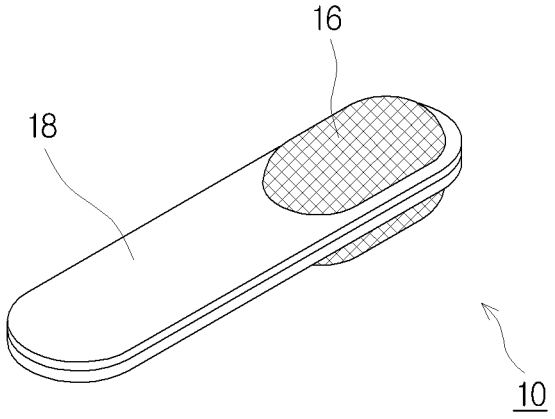

A method for injecting the tea 17 into the stick-type tea bag 10 of FIG. 8 will be described in more detail with reference to the perspective view of FIG. 9. As shown in FIG. 9, tea is stored in an injecting machine 100. The board is folded based on the center line C as shown in FIG. 9 so that two regions E1, E2 face each other. Three sides of the board (dashed regions) are adhered except for one side (one direction) through which the injecting machine 100 will enter. The injecting machine 100 enters the folded board 11 and injects a certain amount of tea into the storage bag 16, and then moves upwards a little. After that, a first boundary F1 is adhered. If the first boundary F1 is adhered, the injecting machine 100 injects tea into another storage bag 162, and a second boundary F2 is adhered again. Finally, tea is injected to another storage bag 163, and a third boundary F3 is adhered. After that, if the board is cut in parallel to the first boundary F1, a stick-type tea bag 10 is completely produced as shown in FIG. 10. Tea is stored in the storage bag 16, and the handle unit 18 is fixed to the storage bag 16.

As described above, in the method for manufacturing a stick-type tea bag according to this embodiment, a space for storing tea is ensured using the push rods 151, 152.

Figure 11:
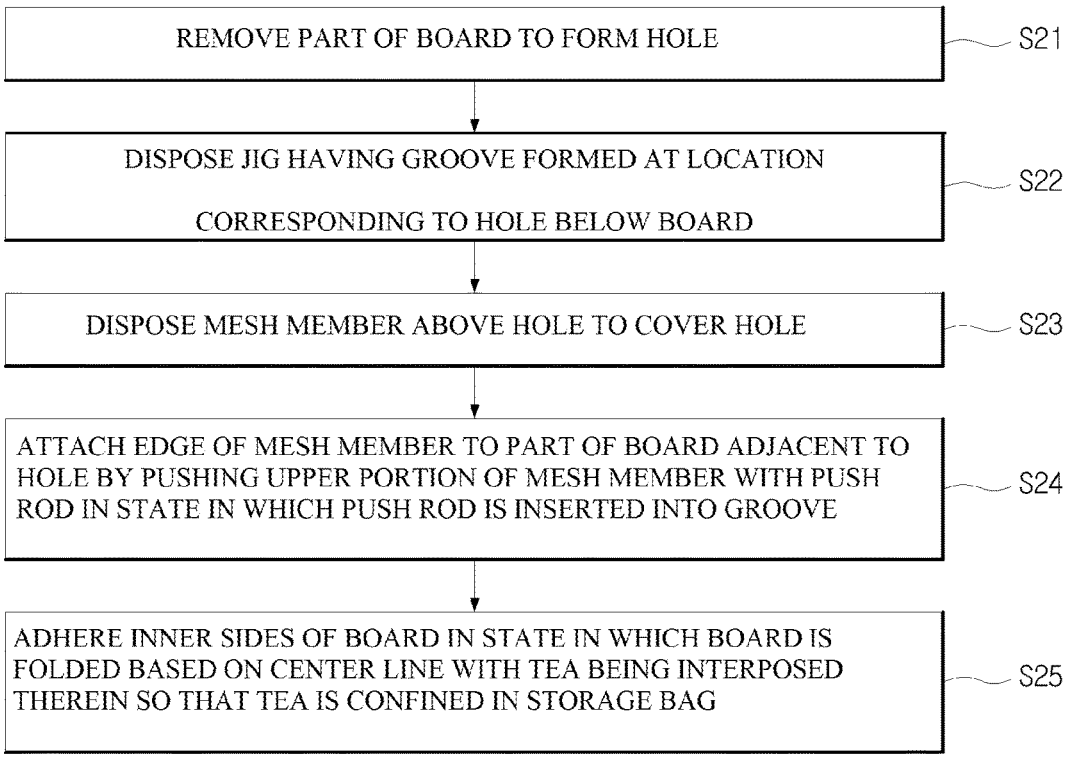
FIG. 11 is a flowchart for illustrating a method for manufacturing a stick-type tea bag according to the second embodiment of the present disclosure.
Figure 18:
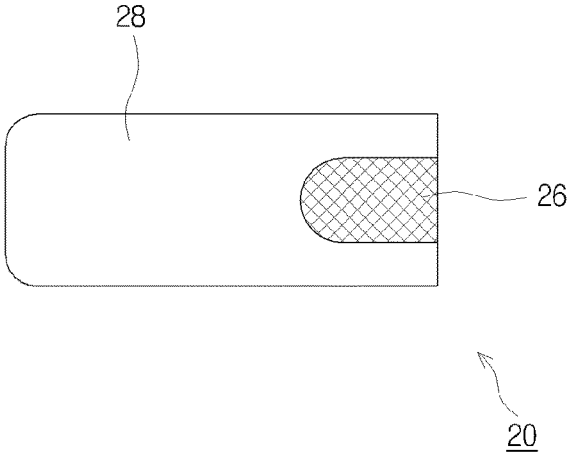

FIG. 11 is a flowchart for illustrating a method for manufacturing a stick-type tea bag according to the second embodiment of the present disclosure, and FIGS. 12 to 18 are diagrams for illustrating a method for manufacturing a stick-type tea bag according to the second embodiment of the present disclosure, wherein FIGS. 12 to 17 are cross-sectional views, and FIG. 18 is a plane view.

In a stick-type tea bag 20 of this embodiment, a storage bag 26 is formed using a single hole 22 formed in a board 21, and tea is stored in the storage bag 26.

Figure 12:
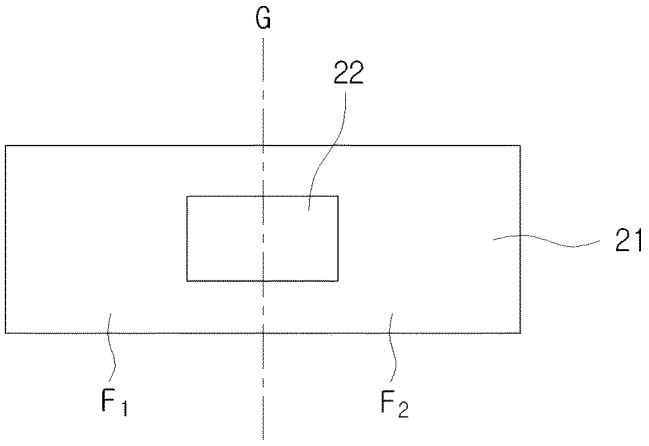
Figure 13:
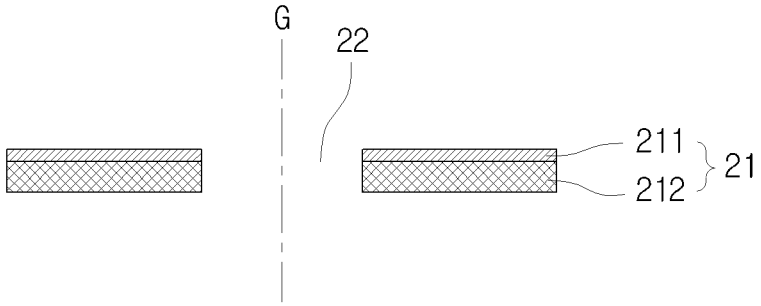
Figure 14:
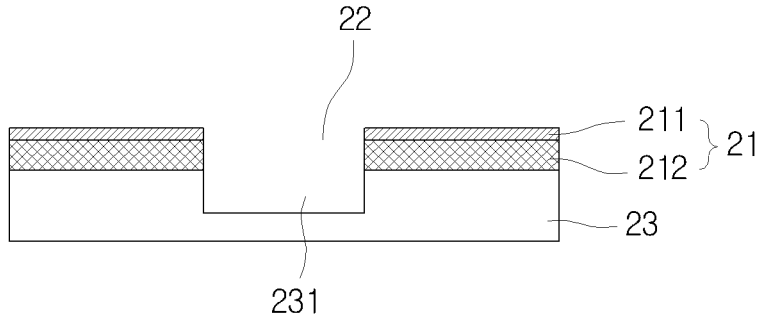
Figure 15:
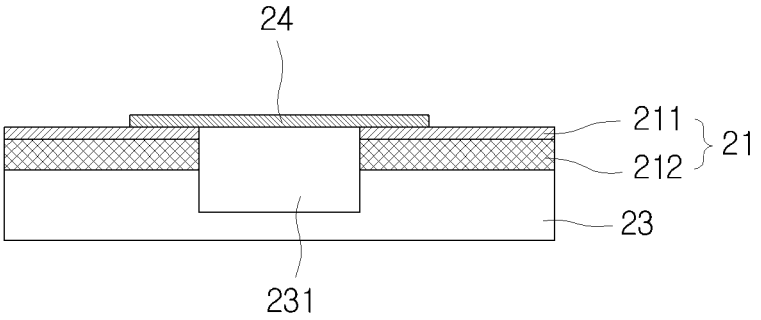
Figure 16:
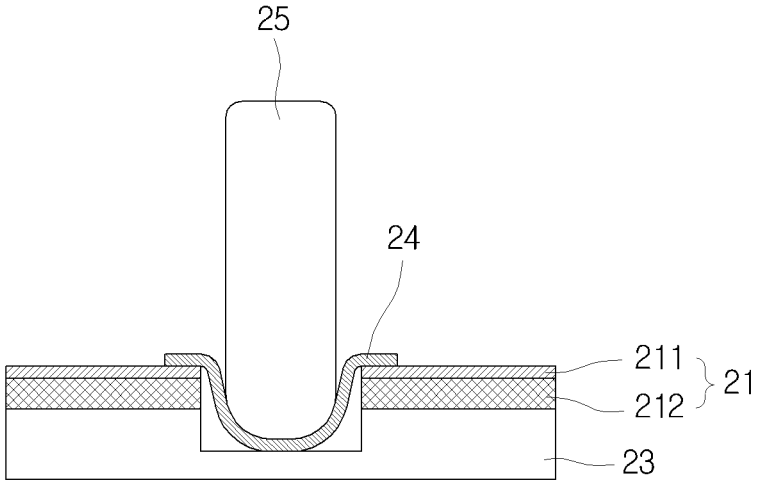
Figure 17:
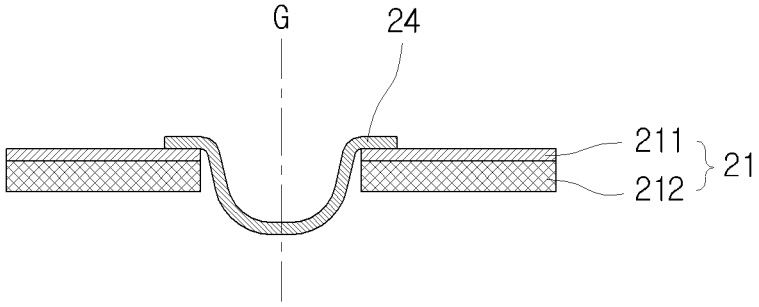

S21 is a step for removing a part of the board 21 to form the hole 22. The board 21 may be made of paper or synthetic resin. The board 21 may be composed of a base member 212 and a synthetic resin film 211 attached to the base member 212. FIG. 12 is a plane view showing that the hole 22 is formed by punching the board 21. Based on a virtual center line G located at the hole 22, the board 21 is classified into a left region F1 and a right region F2. FIG. 13 is a cross-sectional view showing that the board 21 of FIG. 12 is cut in the length direction.

S22 is a step for disposing a jig 23, which has a groove 231 at a location corresponding to the hole 22, below the board 21. The jig 23 may be made of various materials such as wood, plastic or metal. The groove 231 may also be formed through the jig.

S23 is a step for disposing a mesh member 24 above the hole 22 to cover the hole 22. The mesh member 24 may made of any material which allows air and water to pass and is not harmful to a human body, for example Korean paper, non-woven fabric, synthetic resin mesh or the like.

Steps S22 and S23 may be performed in order, or Step S22 may also be performed after Step S23 is performed.

S24 is a step for attaching an edge of the mesh member 241 to a part of the board 21 adjacent to the hole 22 by pushing the upper portion of the mesh member 24 with a push rod 25, in a state in which the push rod 25 is inserted into the groove 231. If the push rod 25 is pressed, the mesh member 241 is inserted into the groove 231 in winding. In this state, the edge of the mesh member 24 is attached to the part of the board 21 adjacent to the hole 22. The attaching method may be thermal fusing. The synthetic resin film 211 of the board 21 may be thermally melted and attached to the mesh member 24. As a result, as shown in the cross-sectional view of FIG. 17, the mesh member 24 maintains a downwardly convex shape.

S25 is a step for adhering inner sides of the board 21 in a state in which the board 21 is folded based on a center line G with tea being interposed therein so that the tea is confined in a storage bag 26. In the cross-sectional view of FIG. 17, if the board 21 is folded based on the center line G and thermally fused, the board 21 comes into a state of FIG. 18. FIG. 18 is a plane view of the stick-type tea bag 20.

Referring to FIG. 18, it may be found that one side of the storage bag 26 becomes an appearance of the stick-type tea bag 20. As described above, in this embodiment, the storage bag 26 may be formed by attaching the mesh member 24 to a single hole 22, different from the embodiment depicted in FIGS. 1 to 10.

Figure 19:
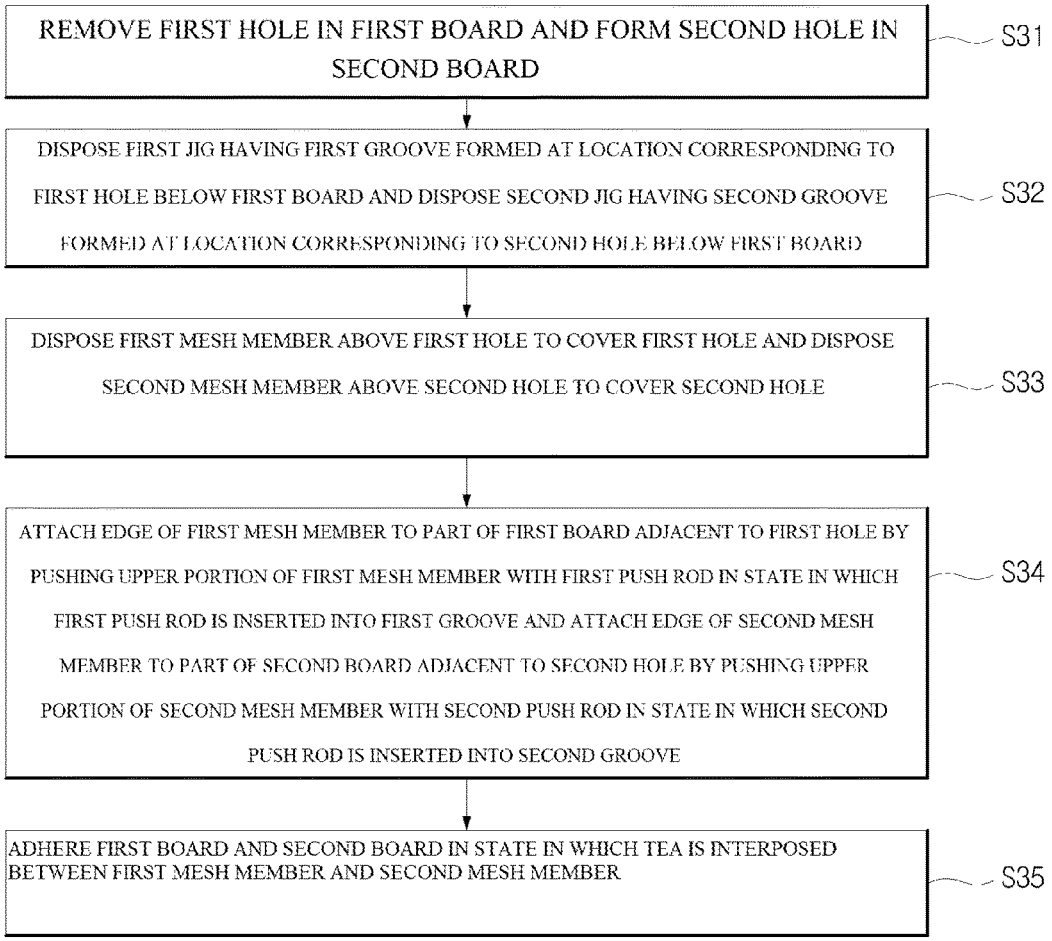
FIG. 19 is a flowchart for illustrating a method for manufacturing a stick-type tea bag according to the third embodiment of the present disclosure.
Figure 20:
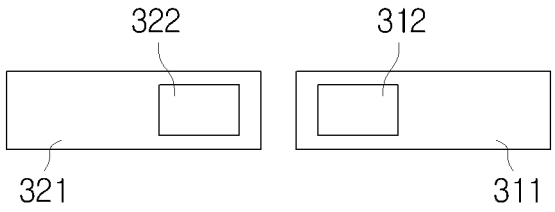
Figure 21:
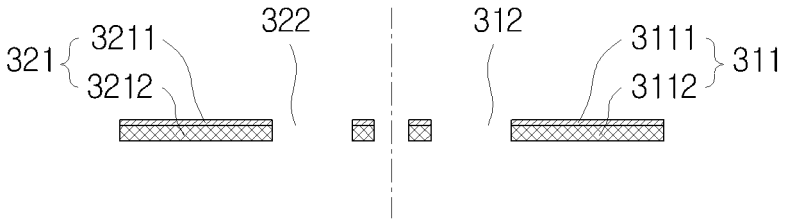
Figure 22:
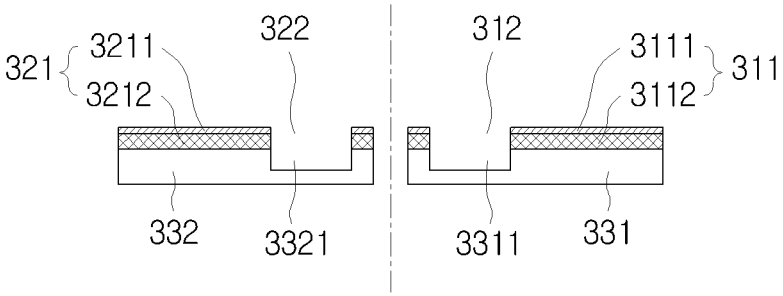
Figure 23:
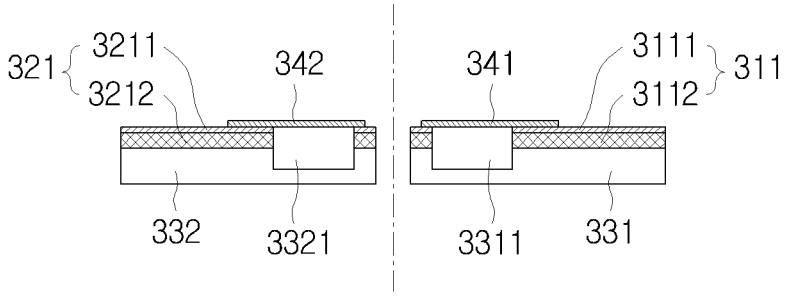
Figure 24:
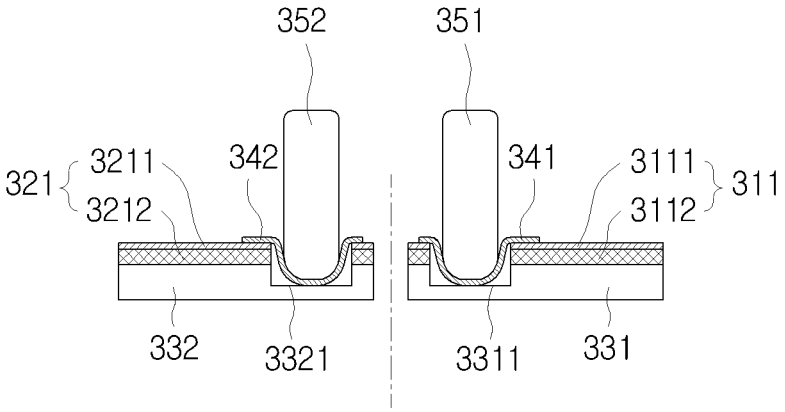
Figure 25:
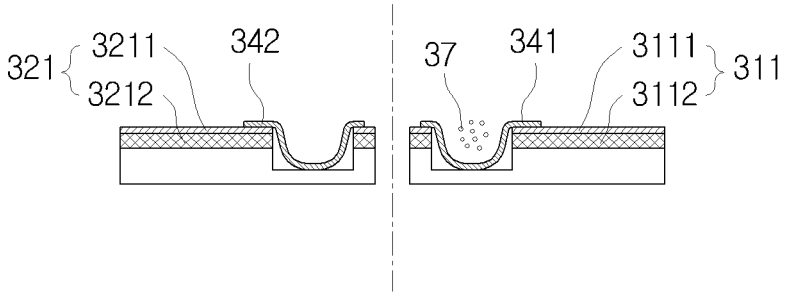
Figure 26:
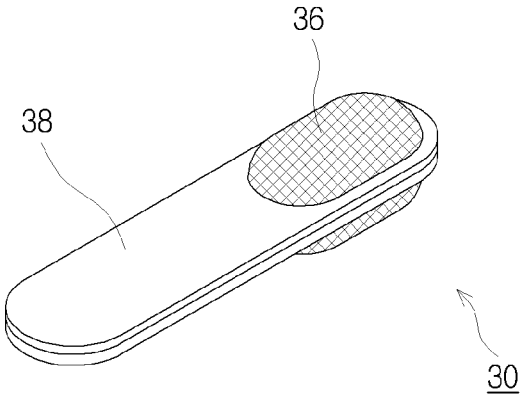

FIG. 19 is a flowchart for illustrating a method for manufacturing a stick-type tea bag according to the third embodiment of the present disclosure, and FIGS. 20 to 26 are diagrams for illustrating a method for manufacturing a stick-type tea bag according to the third embodiment of the present disclosure, wherein FIG. 20 is a plane view. FIGS. 21 to 25 are cross-sectional views, and FIG. 26 is a perspective view.

S31 is a step for forming a first hole 312 in a first board 311 and forming a second hole 322 in a second board 321 (see FIG. 20).

The first board 311 and the second board 321 may be made of the same material. Therefore, in this embodiment, only the first board 311 will be described.

The first board 311 may be made of paper or synthetic resin. The first board 311 may be composed of a base member 3112 and a synthetic resin film 3111 attached to the base member 3112. FIG. 20 is a plane view showing that the first hole 312 is formed by punching the first board 311. In the same way, the second hole 322 may be formed in the second board 321.

S32 is a step for disposing a first jig 331, which has a first groove 3311 at a location corresponding to the first hole 312, below the first board 311 and disposing a second jig 332, which has a second groove 3321 at a location corresponding to the second hole 322, below the second board 321.

The first jig 331 and the second jig 332 have the same shape. Therefore, in this embodiment, only the first jig 331 will be described. The first jig 331 may be made of various materials such as wood, plastic or metal. The first groove 3311 may also be formed through the first jig 331 (see FIG. 22).

S33 is a step for disposing a first mesh member 341 above the first hole 312 to cover the first hole 312 and disposing a second mesh member 342 above the second hole 322 to cover the second hole 322. The first mesh member 341 and the second mesh member 342 are identical to each other. Therefore, in this embodiment, only the first mesh member 341 will be described.

The first mesh member 341 may made of any material which allows air and water to pass and is not harmful to a human body, for example Korean paper, non-woven fabric, synthetic resin mesh or the like.

S34 is a step for attaching an edge of the first mesh member 341 to a part of the first board 311 adjacent to the first hole 312 by pushing an upper portion of the first mesh member 341 with a first push rod 351 in a state in which the first push rod 351 is inserted into the first groove 3311; and attaching an edge of the second mesh member 342 to a part of the second board 332 adjacent to the second hole 322 by pushing an upper portion of the second mesh member 342 with a second push rod 352 in a state in which the second push rod 352 is inserted into the second groove 3321.

If the first push rod 351 is pressed, the first mesh member 341 is inserted into the first groove 3311 in winding. In this state, the edge of the first mesh member 341 is attached to the part of the first board 311 adjacent to the first hole 312. The attaching method may be thermal fusing. The synthetic resin film 3111 of the first board 311 may be thermally melted and attached to the first mesh member 341. As a result, as shown in the cross-sectional view of FIG. 25, the first mesh member 341 maintains a downwardly convex shape.

In the same way, the second mesh member 342 may also be attached to the second board 321 in a downwardly convex shape.

S35 is a step for adhering the first board 311 and the second board 321 in a state in which the tea 37 is interposed between the first mesh member 341 and the second mesh member 342. If the first board 311 and the second board 321 are adhered with the tea 37 being interposed therein, a stick-type tea bag 30 as shown in FIG. 26 is completely produced. The stick-type tea bag 30 is composed of a handle unit 38 and a storage bag 36 coupled to an end of the handle unit 38. The tea 37 is stored in the storage bag 36. The storage bag 36 is formed by coupling the first mesh member 341 and the second mesh member 342 in a state of facing each other.

In the above embodiment, in a state in which the push rod is pressed, a storage bag having a space for storing tea may be formed by adhering the mesh member to the board.

The embodiments of the present disclosure have been described in detail. However, the embodiments are just for illustrations and not intended to limit the scope of the appended claims. Many changes, modifications and equivalents can be made thereto by those having ordinary skill in the art. Such changes, modifications and equivalents also fall within the scope of the present disclosure.

INDUSTRIAL APPLICABILITY

A disposable stick-type tea bag may be manufactured according to the present disclosure. This stick-type tea bag may be used in the food and beverage fields.

What is claimed is:

1. A method for manufacturing a stick-type tea bag, comprising:

(a) forming a part of a board to form a pair of holes symmetrically based on a virtual center line formed at the board;

(b) disposing a jig, which has grooves at locations respectively corresponding to the pair of holes, below the board;

(c) disposing a mesh member on the pair of holes to respectively cover the pair of holes;

(d) attaching an edge of the mesh member to a part of the board adjacent to the holes by pushing an upper portion of the mesh member with a push rod, in a state in which the push rod is inserted into the groove; and (e) adhering inner sides of the board in a state in which the board is folded based on the center line with tea being interposed therein so that the tea is confined in a storage bag.

2. The method for manufacturing a stick-type tea bag according to claim 1, wherein a plurality of hole pairs is formed in a row along the center line, and wherein the step (e) includes:

(e1) folding the board and adhering inner sides of the board so that three sides of the board are closed; and (e2) injecting the tea through an open side of the board, and then adhering the open side to close the board.

3. The method for manufacturing a stick-type tea bag according to claim 2, wherein a synthetic resin film is coupled to the board, wherein in the step (d), the edge of the mesh member is thermally fused to the synthetic resin film attached to the board so that the edge of the mesh member is coupled to a part of the board, and wherein in the step (e), the synthetic resin films at inner sides of the board are thermally fused to each other so that the inner sides of the board are adhered.

4. The method for manufacturing a stick-type tea bag according to claim 3, wherein a fold line is formed at the center line to help folding of the board.

5. A method for manufacturing a stick-type tea bag, comprising:

(a) removing a part of a board to form a hole;

(b) disposing a jig, which has a groove at a location corresponding to the hole, below the board;

(c) disposing a mesh member above the hole to cover the hole;

(d) attaching an edge of the mesh member to a part of the board adjacent to the hole by pushing an upper portion of the mesh member with a push rod, in a state in which the push rod is inserted into the groove; and (e) adhering inner sides of the board in a state in which the board is folded based on a center line of the hole with tea being interposed therein so that the tea is confined in a storage bag.

6. The method for manufacturing a stick-type tea bag according to claim 5, wherein a synthetic resin film is coupled to the board, wherein in the step (d), the edge of the mesh member is thermally fused to the synthetic resin film attached to the board so that the edge of the mesh member is coupled to a part of the board, and wherein in the step (e), the synthetic resin films at inner sides of the board are thermally fused to each other so that the inner sides of the board are adhered.

7. A method for manufacturing a stick-type tea bag, comprising:

(a) forming a first hole in a first board and forming a second hole in a second board;

(b) disposing a first jig, which has a first groove at a location corresponding to the first hole, below the first board and disposing a second jig, which has a second groove at a location corresponding to the second hole, below the second board;

(c) disposing a first mesh member on the first hole to cover the first hole and disposing a second mesh member on the second hole to cover the second hole;

(d) attaching an edge of the first mesh member to a part of the first board adjacent to the first hole by pushing an upper portion of the first mesh member with a first push rod, in a state in which the first push rod is inserted into the first groove, and attaching an edge of the second mesh member to a part of the second board adjacent to the second hole by pushing an upper portion of the second mesh member with a second push rod, in a state in which the second push rod is inserted into the second groove; and (e) adhering the first board and the second board in a state in which tea is interposed between the first mesh member and the second mesh member.

* * * * *